US006732882B2

(12) United States Patent
Belcastro

(10) Patent No.: US 6,732,882 B2
(45) Date of Patent: May 11, 2004

(54) NO-SPILL COVER ASSEMLY FOR A DRINK CONTAINER

(75) Inventor: Domenic Belcastro, Fraser, MI (US)

(73) Assignee: Niko Products, Inc., Shelby Township, MI (US)

( * ) Notice: Subject to any disclaimer, the term of this patent is extended or adjusted under 35 U.S.C. 154(b) by 36 days.

(21) Appl. No.: 10/141,398

(22) Filed: May 8, 2002

(65) Prior Publication Data

US 2003/0209555 A1 Nov. 13, 2003

(51) Int. Cl.[7] ..... A47G 19/22

(52) U.S. Cl. ..... 220/714; 220/717; 220/203.28; 220/303; 215/11.5; 215/311; 222/482

(58) Field of Search ..... 220/203.11, 203.18, 220/203.19, 203.28, 303, 711, 714, 717, 719; 215/309, 311, 260, 11.4, 11.5; 222/481.5, 482; 137/198

(56) References Cited

U.S. PATENT DOCUMENTS

| | | | | | |
|---|---|---|---|---|---|
| 3,739,938 | A | * | 6/1973 | Paz | 220/715 |
| 5,706,973 | A | * | 1/1998 | Robbins et al. | 220/714 |
| 5,890,619 | A | * | 4/1999 | Belanger | 220/713 |
| 5,890,620 | A | * | 4/1999 | Belcastro | 220/714 |
| 6,050,445 | A | * | 4/2000 | Manganiello | 220/714 |
| RE37,016 | E | * | 1/2001 | Morano | 220/714 |
| 6,264,166 | B1 | * | 7/2001 | Bowland et al. | 251/144 |
| 6,269,968 | B1 | * | 8/2001 | Belcastro | 220/714 |
| 6,305,570 | B1 | * | 10/2001 | Atkin et al. | 220/714 |
| 6,325,236 | B1 | * | 12/2001 | Wong | 220/713 |
| 6,422,415 | B1 | * | 7/2002 | Manganiello | 220/714 |
| 6,508,379 | B1 | * | 1/2003 | Van De Pol-Klein Nagelvoort et al. | 220/714 |
| 2001/0042755 | A1 | * | 11/2001 | Belcastro | 220/714 |

* cited by examiner

*Primary Examiner*—Nathan J. Newhouse
*Assistant Examiner*—James Smalley
(74) *Attorney, Agent, or Firm*—Artz & Artz, P.C.

(57) ABSTRACT

A no-spill cover assembly (14) includes a lid assembly (16) that is releasably mated to the drink container (10). The lid assembly (16) has an outlet channel (22) and an inlet channel (24) integrally formed therein. Furthermore, the cover assembly (14) includes a one-piece valve assembly (18) for attachment to the lid assembly (16). The one-piece valve assembly (18) is an integral one-piece structure that is formed of a flexible material and includes has an outlet valve portion (36) and an inlet valve portion (38). The outlet valve portion (36) includes a resilient outlet flange (44) that is positioned within the outlet channel (22) for selectively permitting a first flow therethrough and out of the drink container. The inlet valve portion (38) includes a resilient inlet flange (54) that is positioned within the inlet channel (24) for selectively permitting a second flow therethrough and into the drink container (10).

17 Claims, 2 Drawing Sheets

NO-SPILL COVER ASSEMLY FOR A DRINK CONTAINER

TECHNICAL FIELD

The present invention relates generally to drink containers, and more particularly to a no-spill cover assembly for automatically sealing beverages within a drink container.

BACKGROUND OF THE INVENTION

Cups are well known drink containers. Spills frequently occur through the open mouths of cups when the cups are jarred, tipped, dropped, or otherwise subjected to sudden movements.

One proposed solution for eliminating accidental spills associated with cups employs a plastic lid that snaps onto the rim of a cup. These lids are commonly found in fast food restaurants and coffee outlets. These lids typically have one or more holes for allowing a user to withdraw the beverage from the cup. By reducing the size of the opening through which the beverage exits the cup, the likelihood of spills is subsequently reduced.

However, these lids fail to eliminate accidental spills because the beverage may still escape through the opening despite its reduced size. For instance, jarring the cup can cause the beverage to splash out of the cup through its opening even though the cup may be in an upright position. Moreover, the beverage can pour out of the cup through the opening if the cup is tipped onto its side. If the cup is dropped, the lid can become dislodged from the cup and the entire contents of the cup can be lost.

Another proposed solution involves a lid that is secured to a cup by a threaded engagement. One variation of this solution further requires a lid having a hole formed therein for allowing a straw to be inserted into the cup for withdrawing the beverage. This variation also includes a cap that can be manually placed on the end of the straw in order to seal the beverage within the cup.

Another variation involves a pop-up vent formed within the lid. The pop-up vent seals the cup when the vent is manually pushed down and permits the beverage to exit the cup when the vent is pulled up.

In both these variations, the threaded engagement secures the lid to the cup to prevent the lid from becoming dislodged from the cup if it is dropped. Both variations also effectively prevent a beverage from splashing out of the cup if the cup is jarred while it is in an upright position. However, unless the user manually places the cap onto the straw or pushes down the pop-up vent, the beverage can spill out of the cup if it is tipped onto its side or if the cup is too full.

Yet another proposed solution for a no-spill cup is an automatically sealing cup as disclosed in U.S. Pat. No. 5,890,620. The '620 patent provides a cup having a multiple-piece valve assembly that is intended to engage a lid assembly. Unfortunately, while the cup disclosed therein provides improved sealability, the valve assembly includes several parts that can complicate its design and manufacture. As a result, manufacturing cycle time and costs associated therewith are increased.

Moreover, the intricate design makes it relatively difficult to access all surface areas of the valve assembly and the lid assembly for the purpose of cleaning them. The valve assembly typically must be removed from the lid assembly and then taken apart and broken down into its several components every time the user wishes to clean the valve assembly after use. Also, since the individual components are small, they can be misplaced or lost. The time and effort required to dismantle the valve assembly, as well as to handle its small components, make cleaning of the valve assembly a somewhat cumbersome task.

Therefore, it would be desirable to provide a no-spill cover assembly that automatically seals beverages within the drink container and has a simple structure for permitting easy cleaning and for decreasing manufacturing cycle time and associated manufacturing costs.

SUMMARY OF THE INVENTION

It is therefore an object of the present invention to provide a no-spill cover assembly for automatically sealing a beverage within a drink container.

Another object of the present invention is to provide a no-spill cover assembly that is constructed in such a manner that it can be easily cleaned.

It is still another object of the present invention to provide a no-spill cover assembly having a minimal number of components so as to reduce manufacturing cycle time and costs associated therewith.

In accordance with the above and other objects of the present invention, a no-spill cover assembly is provided. The cover assembly includes a lid assembly that is releasably mated to a drink container for the purpose of covering an opening of the drink container. The lid assembly has an outlet channel and an inlet channel integrally formed therein.

Furthermore, the lid assembly is adapted to receive a one-piece valve assembly. The one-piece valve assembly has an outlet valve portion and an inlet valve portion integrally formed therein. The outlet valve portion includes a resilient outlet flange that is positioned within the outlet channel for selectively permitting a first flow therethrough and out of the drink container. The inlet valve portion includes a resilient inlet flange that is positioned within the inlet channel for selectively permitting a second flow therethrough and into the drink container.

One advantage of the present invention is that the cover assembly automatically seals the drink container and prevents accidental spills.

Another advantage of the present invention is that the one-piece valve assembly is readily detachable from the lid assembly to permit easy and thorough cleaning of the entire cover assembly.

Yet another advantage of the present invention is that the cover assembly has relatively few components thereby reducing the likelihood of misplacing or losing the components.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DESCRIPTION OF THE PREFERRED EMBODIMENT

Figure 1:
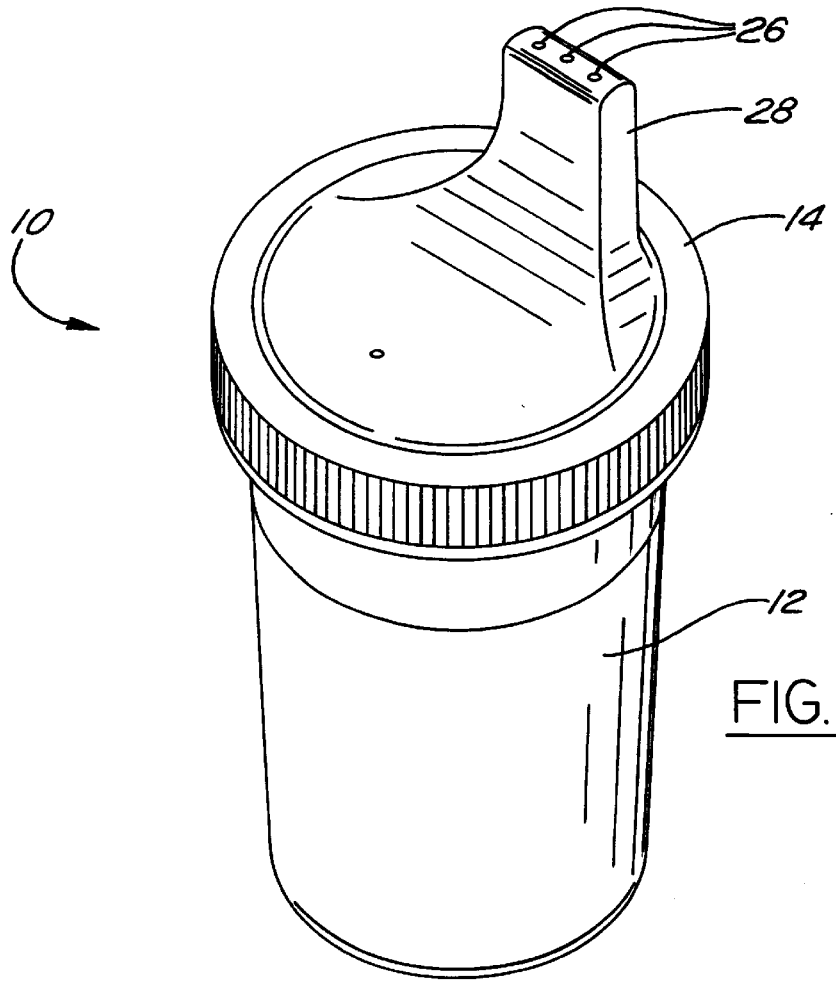
FIG. 1 is a perspective view of a drink container having a no-spill cover assembly according to a preferred embodiment of the present invention.

In the following figures, the same reference numerals are used to identify the same components in the various views.

Referring to FIG. 1, there is generally shown a perspective view of a drink container 10 according to a preferred embodiment of the present invention. The drink container 10 includes a cup 12 and a no-spill cover assembly 14 that sealingly covers an opening of the cup 12. The cover assembly 14 includes a lid assembly 16 and a one-piece valve assembly 18 (as shown in FIGS. 2A, 2B, and 3) for attachment to a lid assembly 16.

Figure 2A:
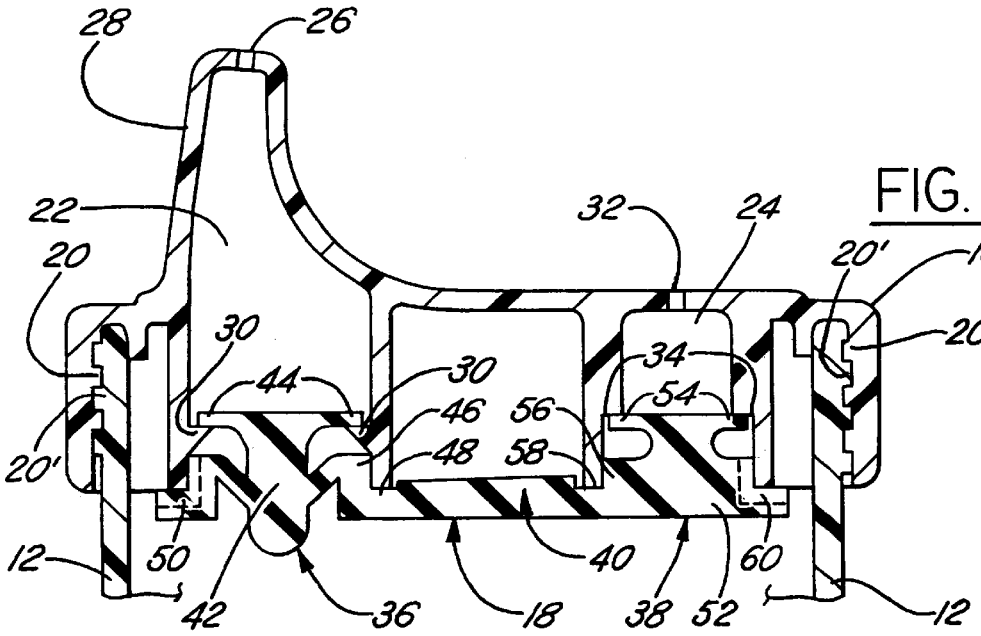
FIG. 2A is a cross-sectional view of a drink container having a no-spill cover assembly in a sealed configuration according to a preferred embodiment of the present invention.
Figure 2B:
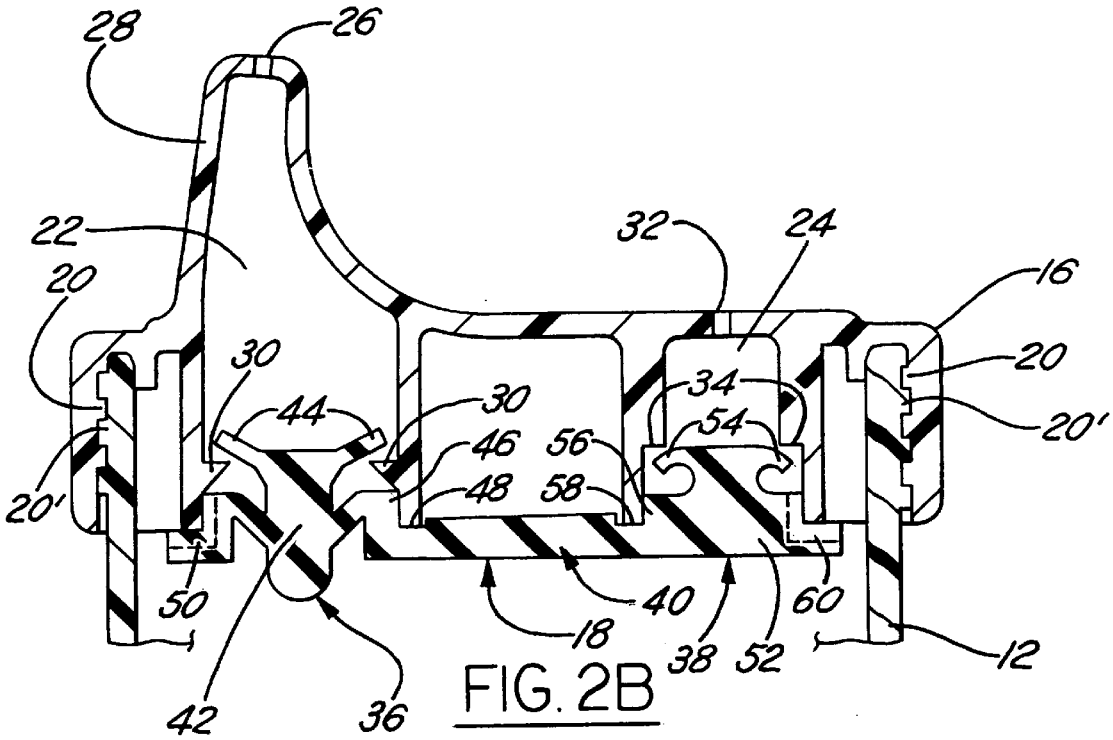
FIG. 2B is a cross-sectional view of a drink container having a no-spill cover assembly in an unsealed configuration according to a preferred embodiment of the present invention.
Figure 3:
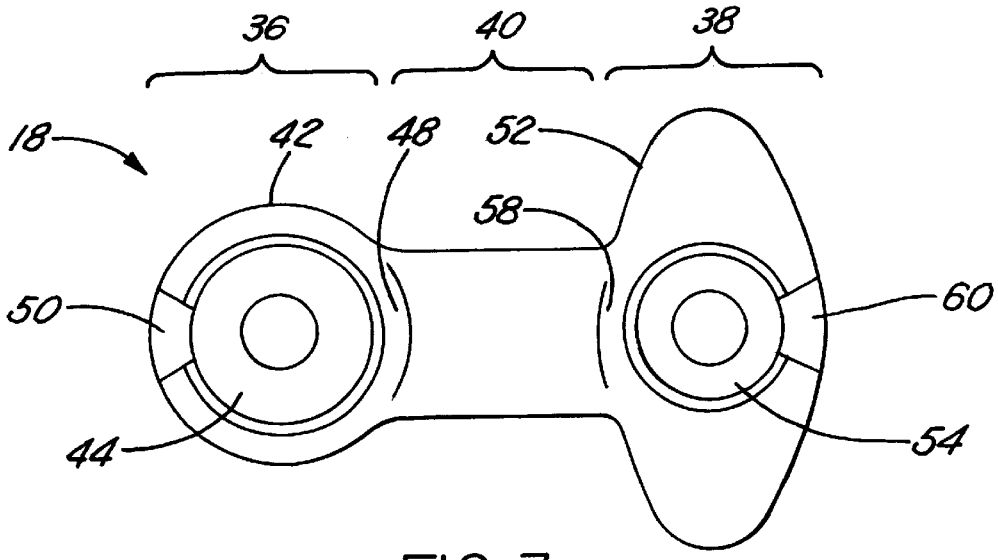
FIG. 3 is a top plan view of a one-piece valve assembly for a no-spill cover assembly according to a preferred embodiment of the present invention.

Referring now to FIGS. 2A and 2B, there are shown cross-sectional views of the cover assembly 14 in a sealed configuration and an unsealed configuration, respectively.

The lid assembly 16 has a fastener 20 integrally formed therein for engaging an opposing fastener 20' integrally formed on the cup 12. These fasteners 20, 20' preferably are opposing threaded fasteners, but obviously may be various other suitable fasteners for mating the lid assembly 16 to the cup 12 to ensure a tight fit and prevent leakage.

The lid assembly 16 also has an outlet channel 22 and an inlet channel 24 integrally formed therein. The outlet channel 22 is intended to allow a beverage to flow from an interior of the drink container 10 to an exterior thereof thereby allowing a user to drink from the cup 12. The beverage may pass 10 through one or more outlet holes 26 formed within the lid assembly 16, at a top end of the outlet channel 22.

In addition, the lid assembly 16 preferably includes a spout 28 defining a top portion of the outlet channel 22. The spout 28 may be sized for allowing a person, e.g. a young child, to wrap his mouth around the spout 28 while drinking from the drink container 10. It will be obvious to one skilled in the art that the lid assembly 16 may define the outlet channel 22 in a variety of other suitable ways.

The outlet channel 24 has an outlet valve seat 34 disposed therein. Preferably, the outlet valve seat 34 is integrally formed as part of the lid assembly 16. The outlet valve seat 30 and its function are discussed in detail in the description for the outlet valve portion 36 of the one-piece valve assembly 18.

In an alternative embodiment of the present invention, the lid assembly 16 does not have the outlet valve seat 30 integrally formed therein. Instead, the lid assembly 16 is adapted to receive an outlet seat insert within the outlet channel 22. In this regard, a separate component is attached to the lid assembly 16 in order to provide a lid structure similar to the one provided by the preferred embodiment. This alternate method of construction may be required to alleviate limitations of manufacturing methods, e.g. injection molding. Obviously, the structure of the lid assembly 16 may be accomplished by other suitable methods of construction.

The inlet channel 24 is intended to permit air to be drawn into the drink container 10 thereby allowing a user to more easily withdraw the beverage from the cup 12. Air may enter the drink container 10 through one or more inlet holes 32 formed within the lid assembly 16, at a top end of the inlet channel 24. As one skilled in the art would understand, the incoming air replaces the beverage withdrawn from the drink container 10 thereby preventing a substantial decrease in pressure within the drink container 10. Consequently, the user can apply less suction to withdraw the beverage from the drink container 10.

Furthermore, the inlet channel 24 has an inlet valve seat 34 disposed therein. Preferably, the inlet valve seat 34 is integrally formed as part of the lid assembly 16. The inlet valve seat 34 and its function are discussed in detail in the description for the inlet valve portion 38 of the one-piece valve assembly 18.

Referring now to FIG. 3, a top plan view of a one-piece valve assembly 18 is shown according to a preferred embodiment of the present invention. The one-piece valve assembly 18 is releasably mated to the lid assembly 16. Preferably, the one-piece valve assembly 18 is composed of a flexible material, e.g. injection molded silicone. However, it is understood that the one-piece valve assembly 18 may be made of various other suitable materials.

The one-piece valve assembly 18 preferably is a single integral piece including an outlet valve portion 36 and an inlet valve portion 38, with an intermediate connector portion 40 extending therebetween.

The outlet valve portion 36 of the one-piece valve assembly 18 includes an outlet base 42 and a resilient outlet flange 44 extending from the outlet base 42. As best shown in FIG. 2A, the outlet valve portion 36 is mounted within the outlet channel 22 by inserting the outlet valve portion 36 into the outlet channel 22 and engaging the resilient outlet flange 44 to the outlet valve seat 30. The engagement between the resilient outlet flange 44 and the outlet valve seat 30 is intended to automatically seal the beverage within the drink container 10.

Moreover, the outlet base 42 is sized to mate with the lid assembly 16 for the purpose of positioning the outlet flange 44 within the outlet channel 22 such that the outlet flange 44 engages the outlet valve seat 30. The outlet base 42 may have several surfaces for guiding and locating the resilient outlet flange 44 within the outlet channel 22. For example, the outlet base 42 may have a first surface 46 that centers the flange within the outlet channel 22. In addition, the outlet base 42 may also have a second surface 48 for placing the resilient outlet flange 44 at a desired depth within the outlet channel 22.

The outlet base 42 also preferably has an outlet recess 50 formed therein for permitting the beverage to flow into the outlet channel 22 and out of the drink container 10.

The inlet valve portion 38 includes an inlet base 52 and a resilient inlet flange 54 extending from the inlet base 52. The one-piece valve assembly 18 is formed such that the inlet valve portion 38 is held within the inlet channel 24 when the outlet valve portion 36 is mated to the outlet channel 22.

Similar to the outlet base 42, the inlet base 52 is sized to mate with the lid assembly 16 for the purpose of positioning the resilient inlet flange 54 within the inlet channel 24 such that the inlet flange 54 engages the inlet valve seat 34. The inlet base 52 preferably uses a first surface 56 and second surface 58 for guiding and locating the inlet flange 54 within the inlet channel 24.

The inlet base 52 also preferably has an inlet recess 60 formed therein for permitting air to flow from the inlet channel 24 into the cup 12.

The one-piece valve assembly 18 may be easily detached from the lid assembly 16 to allow for easy and thorough cleaning of the entire cover assembly 14. Since there are preferably only two separate components of the cover assembly 14, dismantling and assembling the cover assembly 14 is a simple process. After cleaning the cover assembly 14, the one-piece valve assembly 18 may be easily reattached to the lid assembly 16.

In operation, the cover assembly 14 remains in a sealed configuration (as shown in FIG. 2A) if two conditions exist. The first condition requires that a first pressure differential across the resilient outlet flange 44 is below a first pressure threshold. The first pressure threshold is the pressure differential required to bend the resilient outlet flange 44 away from the outlet valve seat 30. Disengaging the outlet flange 44 from the outlet valve seat 30 permits the beverage to flow through the outlet channel 22 and out of the drink container 10.

Likewise, the second condition requires that a second pressure differential across the resilient inlet flange 54 is below a second pressure threshold. The second pressure threshold is the pressure differential required to bend the resilient inlet flange 54 away from the inlet valve seat 34. Disengaging the inlet flange 54 from the inlet valve seat 34 permits air to flow through the inlet channel 24 and into the drink container 10. Therefore, the resilient flanges 44, 54 are sufficiently stiff that they remain sealingly engaged to their respective valve seats 30, 34 and resist deflection until their pressure thresholds are met.

The pressure thresholds depend upon the flexibility of the material composing the flanges 44, 54. For example, if the flanges 44, 54 are made of very flexible material, they may allow the drink container 10 to become unsealed when relatively low pressure differentials exist across the flanges 44, 54.

The cover assembly 14 changes to an unsealed configuration when the user applies sufficient suction pressure to the spout 28 such that the first pressure differential across the resilient outlet flange 44 is greater than the first pressure threshold. The user may drink from the drink container 10 when he applies sufficient suction pressure. In particular, sufficient suction pressure bends the resilient outlet flange 44 upward (as shown in FIG. 2B) thereby permitting the beverage to flow through the outlet recess 50 and the outlet channel 22 and then out of the container 10.

As the beverage is withdrawn from the drink container 10, the pressure within the cup 12 decreases thereby increasing the second pressure differential across the resilient inlet flange 54. If the second pressure differential exceeds the second pressure threshold, then the resilient inlet flange 54 bends downward (as shown in FIG. 2B) and permits air to be drawn into the cup 12. The incoming air replaces the withdrawn beverage and prevents a substantial decrease of pressure within the cup 12. Consequently, as a person of ordinary skill in the art would understand, the inflow of air facilitates the withdrawal of the beverage.

The remaining beverage is automatically re-sealed within the drink container 10 when the first pressure differential across the resilient outlet flange 44 ceases to exceed the first pressure threshold. In particular, the resilient outlet flange 44 sealingly re-engages the outlet valve seat 30 when the user stops applying suction to the spout 28.

In addition, the resilient inlet flange 54 sealingly re-engages the inlet valve seat 34 if the second pressure differential across the resilient inlet flange 54 no longer exceeds the second pressure threshold. For example, the second pressure differential may fall below the second pressure threshold when the user stops applying suction to the spout 28. As a result, the inlet flange 54 re-engages the inlet valve seat 34 and blocks the flow of incoming air.

While particular embodiments of the invention have been shown and described, numerous variations and alternate embodiments will occur to those skilled in the art. Accordingly, it is intended that the invention be limited only in terms of the appended claims.

What is claimed is:

1. A no-spill cover assembly for automatically sealing a beverage within a cup, the no-spill cover assembly comprising:

a lid assembly releasably mated to the cup so as to cover an opening of the cup, said lid assembly having an outlet channel and an inlet channel integrally formed therein; and a one-piece valve assembly releasably engaged to said lid assembly, said one-piece valve assembly having an outlet valve portion integrally formed therein and intended to selectively permit a first flow through said outlet channel, said one-piece valve assembly having an inlet valve portion integrally formed therein and intended to selectively permit a second flow through said inlet channel;

wherein said inlet valve portion includes an inlet base having an inlet stem portion with a resilient inlet flange extending therefrom, said resilient inlet flange intended to selectively engage an inlet valve seat integrally formed as part of said lid assembly within said inlet channel, said inlet stem portion being substantially narrower than said inlet channel for facilitating said first flow through said inlet channel;

wherein said inlet channel defines an intermediate inlet chamber between an interior of the cup and an exterior of the cup, said intermediate inlet chamber for allowing the beverage to leak therein without spilling into said exterior of the cup;

wherein said outlet valve portion of said one-piece valve assembly has an outlet recess for allowing said first flow to pass therethrough;

wherein said inlet valve portion of said one-piece valve assembly has an inlet recess for allowing said second flow to pass therethrough.

2. The no-spill cover assembly of claim 1 wherein said outlet valve portion includes an outlet base having an outlet stem portion with a resilient outlet flange extending therefrom, said resilient outlet flange intended to selectively engage an outlet valve seat integrally formed as part of said lid assembly within said outlet channel, said outlet stem portion being substantially narrower than said outlet channel for facilitating said first flow through said outlet channel.

3. The no-spill cover assembly of claim 2 wherein said resilient outlet flange sealingly mates to said outlet valve seat when a first pressure differential thereacross is below a first pressure threshold.

4. The no-spill cover assembly of claim 1 wherein said resilient outlet flange bends away from said outlet valve seat when said first pressure differential thereacross is above said first pressure threshold.

5. The no-spill cover assembly of claim 1 wherein said resilient inlet flange sealingly mates to said inlet valve seat when a second pressure differential thereacross is below a second pressure threshold.

6. The no-spill cover assembly of claim 1 wherein said resilient inlet flange bends away from said inlet valve seat when said second pressure differential thereacross is above said second pressure threshold.

7. A no-spill cover assembly for automatically sealing a beverage within a cup, the no-spill cover assembly comprising:

a lid assembly releasably mated to the cup so as to cover an opening of the cup, said lid assembly having an outlet channel and an inlet channel integrally formed therein; and a one-piece valve assembly releasably engaged to said lid assembly, said one-piece valve assembly having an outlet valve portion, an inlet valve portion, and intermediate portion in connection therebetween, said intermediate portion for being at least partially wedged between said outlet channel and said inlet channel so as to secure said one-piece valve assembly in a desired position on said lid assembly, said outlet valve portion far selectively allowing a first flow through said outlet channel, said inlet valve portion for selectively allowing a second flow through said inlet channel;

wherein said inlet valve portion includes an inlet base having an inlet stem portion with a resilient inlet flange extending therefrom, said resilient inlet flange intended to selectively engage an inlet valve seat integrally formed as part of said lid assembly within said inlet channel, said stem portion being substantially narrower than said inlet channel for facilitating said first flow through said inlet channel;

wherein said inlet channel defines an intermediate inlet chamber between an interior of the cup and an exterior of the cup, said intermediate inlet chamber for allowing the beverage to leak therein without spilling into said exterior of the cup;

wherein said outlet valve portion of said one-piece valve assembly has an outlet recess for allowing said first flow to pass therethrough;

wherein said inlet valve portion of said one-piece valve assembly has an inlet recess for allowing said second flow to pass therethrough.

8. The no-spill cover assembly of claim 7 wherein said outlet valve portion includes an outlet base having an outlet stem portion with a resilient outlet flange extending therefrom, said resilient outlet flange intended to selectively engage said outlet valve seat, said outlet stem portion being substantially narrower than said outlet channel for facilitating said first flow through said outlet channel.

9. The no-spill cover assembly of claim 7 wherein said resilient outlet flange sealingly mates to said outlet valve seat when a first pressure differential thereacross is below a first pressure threshold.

10. The no-spill cover assembly of claim 7 wherein said resilient inlet flange sealingly mates to said inlet valve seat when a second pressure differential thereacross is below a second pressure threshold.

11. The no-spill cover assembly of claim 7 wherein said resilient outlet flange bends away from said outlet valve seat when said first pressure differential thereacross is above said first pressure threshold.

12. The no-spill cover assembly of claim 7 wherein said resilient inlet flange bends away from said inlet valve seat when said second pressure differential thereacross is above said second pressure threshold.

13. A no-spill cover assembly for automatically sealing a beverage within a cup, the no-spill cover assembly comprising:

a lid assembly releasably mated to the cup so as to cover an opening of the cup, said lid assembly having an outlet channel and an inlet channel integrally formed therein; and a one-piece valve assembly releasably engaged to said lid assembly, said one-piece valve assembly having an outlet valve portion, an inlet valve portion, and intermediate portion in connection therebetween, said intermediate portion for being at least partially wedged between said outlet channel and said inlet channel so as to secure said one-piece valve assembly in a desired position on said lid assembly, said outlet valve portion for selectively allowing a first flow through said outlet channel, said inlet valve portion for selectively allowing a second flow through said inlet channel;

wherein said inlet valve portion includes an inlet base having an inlet stem portion with a resilient inlet flange extending therefrom, said resilient inlet flange intended to selectively engage an inlet valve seat integrally formed as part of said lid assembly within said inlet channel, said stein portion being substantially narrower than said inlet channel for facilitating said first flow through said inlet channel;

wherein said inlet channel defines an intermediate inlet chamber between an interior of the cup and an exterior of the cup, said intermediate inlet chamber for allowing the beverage to leak therein without spilling into said exterior of the cup;

wherein said outlet valve portion of said one-piece valve assembly has an outlet recess for allowing said first flow to pass therethrough;

wherein said inlet valve portion of said one-piece valve assembly has an inlet recess for allowing said second flow to pass therethrough;

wherein said outlet base includes a first outlet surface for at least partially wedging said outlet valve portion within said outlet channel, securing said one-piece valve assembly in said desired position, and centering said outlet valve portion within said outlet channel;

wherein said inlet base includes a first inlet surface for at least partially wedging said inlet valve portion within said inlet channel, securing said one-piece valve assembly in said desired position, and centering said inlet valve portion within said inlet channel.

14. The no-spill cover assembly of claim 13 wherein said resilient outlet flange sealingly mates to said outlet valve seat when a first pressure differential thereacross is below a first pressure threshold.

15. The no-spill cover assembly of claim 13 wherein said inlet valve portion of said one-piece valve assembly having a resilient inlet flange that sealingly mates to said inlet valve seat when a second pressure differential thereacross is below a second pressure threshold.

16. The no-spill cover assembly of claim 13 wherein said resilient outlet flange bends away from said outlet valve seat when said first pressure differential thereacross is above said first pressure threshold.

17. The no-spill cover assembly of claim 13 wherein said resilient inlet flange bends away from said inlet valve seat when said second pressure differential thereacross is above said second pressure threshold.

* * * * *